US006877747B2

(12) United States Patent
Moody

(10) Patent No.: US 6,877,747 B2
(45) Date of Patent: Apr. 12, 2005

(54) VIDEO POKER GAME

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/641,554

(22) Filed: Aug. 15, 2003

(65) Prior Publication Data

US 2004/0119236 A1 Jun. 24, 2004

Related U.S. Application Data

(60) Provisional application No. 60/319,475, filed on Aug. 15, 2002.

(51) Int. Cl.[7] ..... A63F 1/00

(52) U.S. Cl. ..... 273/292; 273/274; 463/13

(58) Field of Search ..... 273/292, 274, 273/309; 463/13

(56) References Cited

U.S. PATENT DOCUMENTS 5,042,818 A * 8/1991 Weingardt ..... 463/13
5,100,137 A 3/1992 Fulton ..... 273/85 CP
5,167,413 A 12/1992 Fulton ..... 273/85 CP
5,288,081 A 2/1994 Breeding ..... 273/292
5,417,430 A 5/1995 Breeding ..... 273/292
5,544,892 A 8/1996 Breeding ..... 273/292
5,732,950 A 3/1998 Moody ..... 273/292
5,908,353 A * 6/1999 Andrews ..... 463/13

* cited by examiner

*Primary Examiner*—Benjamin Layno
(74) *Attorney, Agent, or Firm*—John Edward Roethel

(57) ABSTRACT

A player makes a wager to play a draw poker game a wager to play a stud poker game which is allocated over one or more stud poker hands. The player is dealt a draw poker hand. The player is then dealt one or more stud poker hands depending on the number of stud poker hands selected to be played. The player wins or loses depending on the poker hand ranking of each of the stud poker hands. The amount won for each winning hand is based on the poker hand ranking and the amount wagered according to a stud poker pay table. The player plays out the draw poker hand in accordance with the conventional manner of play of draw poker. The amount won for each winning hand is based on the poker hand ranking and the amount wagered according to a draw poker pay table.

8 Claims, 4 Drawing Sheets

VIDEO POKER GAME

CROSS-REFERENCE TO RELATED APPLICATION

This application is based on and claims the benefit of U.S. Provisional Application Ser. No. 60/319,475, filed Aug. 15, 2002, entitled "Video Poker Games."

This invention relates primarily to video poker games, and more particularly to electronic video poker games that combine stud poker with draw poker. The player makes a first wager that applies to one or more stud poker hands and a second wager that applies to the draw poker hand. Winning and losing hands are based on poker hand rankings and the amount of the wager.

BACKGROUND OF THE INVENTION

Electronic video poker has also been a staple in gaming casinos for many years and this well known game is a single player game based on draw poker. The player attempts to achieve a winning poker hand ranking by discarding from an initial five card hand and drawing new cards in order to try and improve his poker hand. A pay table is provided to show the player what he can win based on the poker hand ranking achieved after the draw step and the amount wagered by the player.

There have been attempts to adapt stud poker to an electronic video game format. One attempt involved a single player seven card stud game in which the player makes a first wager and initially received three cards face up. In one version of this game, the player has the option of making additional wagers before the player receives the fourth, fifth, sixth and seventh cards. In another version, the player also has the option of making additional wagers before receiving the fourth, fifth, sixth and seventh cards unless the player has already achieved a winning poker hand combination, in which case the player is not allowed to make additional wagers. In either version, the final seven cards are analyzed and the best five card hand is used to determine the poker hand ranking of the player's hand. A pay table is used based on five card poker hand rankings and the amount wagered by the player to determine the amount won by the player when he achieves a winning hand.

Another popular single player stud poker game is known as DOUBLE DOWN STUD poker. This game is described in U.S. Pat. No. 5,100,137 and U.S. Pat. No. 5,167,413, the disclosures of each of which are incorporated herein by this reference. In DOUBLE DOWN STUD poker, the player makes a first wager and is dealt four cards all face up. The player may make an additional wager prior to receiving the fifth card. After the fifth card is dealt, the five card hand is compared to a pay table to determine if the player has a winning or losing card combination based on poker hand ranking.

Another stud poker game that has been adapted to a single player video poker format is a game known as LET IT RIDE®. In this game, the player makes a wager of three units at the start of each round of play. The player is then shown three cards face up. The player may decrease his wager by one unit or let all three wagers ride. The player is then shown a fourth card. The player may decrease his wager by one unit or let his wagers ride. The player is then shown a fifth card and the poker hand ranking of the final five card hand is used to determine winning or losing plays based on a pay table. The method of play of LET IT RIDE® is described in U.S. Pat. No. 5,288,081, U.S. Pat. No. 5,417,430 and U.S. Pat. No. 5,544,892, the disclosures of which are incorporated herein.

In U.S. Pat. No. 5,732,950 (Moody), the disclosure of which is incorporated herein, there is disclosed a method of playing poker that combines a stud poker hand with a draw poker hand. In this '950 patent, the player is dealt two starting hands—one is a stud poker hand and the other is a draw poker hand. The player makes a first wager on the draw poker hand and the player makes a second wager on the stud poker hand. The draw poker hand is then played out by the player, but replacement cards for those cards discarded by the player from the draw poker hand come only from the associated cards in the stud poker hand. In the preferred embodiment, the stud poker hand is aligned adjacent to the draw poker hand and any card discarded from the draw poker hand is replaced by a duplicate of the adjacent stud poker card.

The final draw poker hand is revealed and analyzed to determine if it is a winning poker hand combination with the winning poker hands being shown in a first pay table associated with draw poker. The player receives an award for winning draw poker hands based on the poker ranking of the draw poker hand and the amount of the player's first wager.

The stud poker hand is revealed and analyzed to determine if it is a winning poker hand combination with the winning poker hands being shown in a second pay table associated with stud poker. The player receives an award for winning stud poker hands based on the poker ranking of the stud poker hand and the amount of the player's second wager.

One of the drawbacks to the method of play described in this patent is that the player can only play a single stud poker hand. In order to increase the playability and enjoyment of a video poker game, it is desirable to offer the player the opportunity to play one or more stud poker hands while at the same time playing a draw poker hand.

It is an object of the present invention to provide a stud poker game combined with a draw poker game so that the player can participate in both stud poker and draw poker as part of the same round of play.

It is a feature of the present invention to allow the player to make a first wager to play a draw poker hand. The player also makes a second wager that is allocated among one or more stud poker hands. The player is then dealt both the draw poker hand and the plurality of stud poker hands that the player has determined to play. For each stud poker hand that is a winning hand combination, the player receives a payout for whatever winning hand combination he achieved based on a pay table and the amount of the player's wager on the winning stud poker hand. The draw poker is then played out by the player according to the conventional manner of play of draw poker.

It is an advantage of the present invention that both draw poker and stud poker may be played in the same round of play and the player has the option of playing multiple hands of stud poker thus increasing the fun and excitement of these video poker games.

Other objects, features and advantages of the present invention will become apparent from a consideration of the following detailed description.

SUMMARY OF THE INVENTION

The method of the present invention involves the player making a first wager to play a draw poker game and a second wager to play a stud poker game. The second wager may be allocated over one or more stud poker hands. The player is dealt a first five card poker hand from a deck of playing cards that will be used as the draw poker hand. The player is then dealt one or more stud poker hands depending on the number of stud poker hands selected to be played by the player.

The player wins or loses depending on the poker hand ranking of each of the stud poker hands. The amount won by the player is based on the poker hand ranking of any winning stud poker hand and the amount wagered by the player according to a stud poker pay table.

The player then plays out the draw poker hand in accordance with the conventional manner of play of draw poker. The amount won by the player is based on the poker hand ranking of any winning draw poker hand and the amount wagered by the player according to a draw poker pay table.

DETAILED DESCRIPTION OF THE PREFERRED EMBODIMENTS

The present invention is preferably an electronic video stud poker and draw poker game and is designed to be played by having the stud poker hand and the draw poker hand displayed on a video screen. Alternatively, the present invention can also be played as a live table game with a dealer shuffling and dealing hands to one or more players seated around a gaming table.

Figure 1:
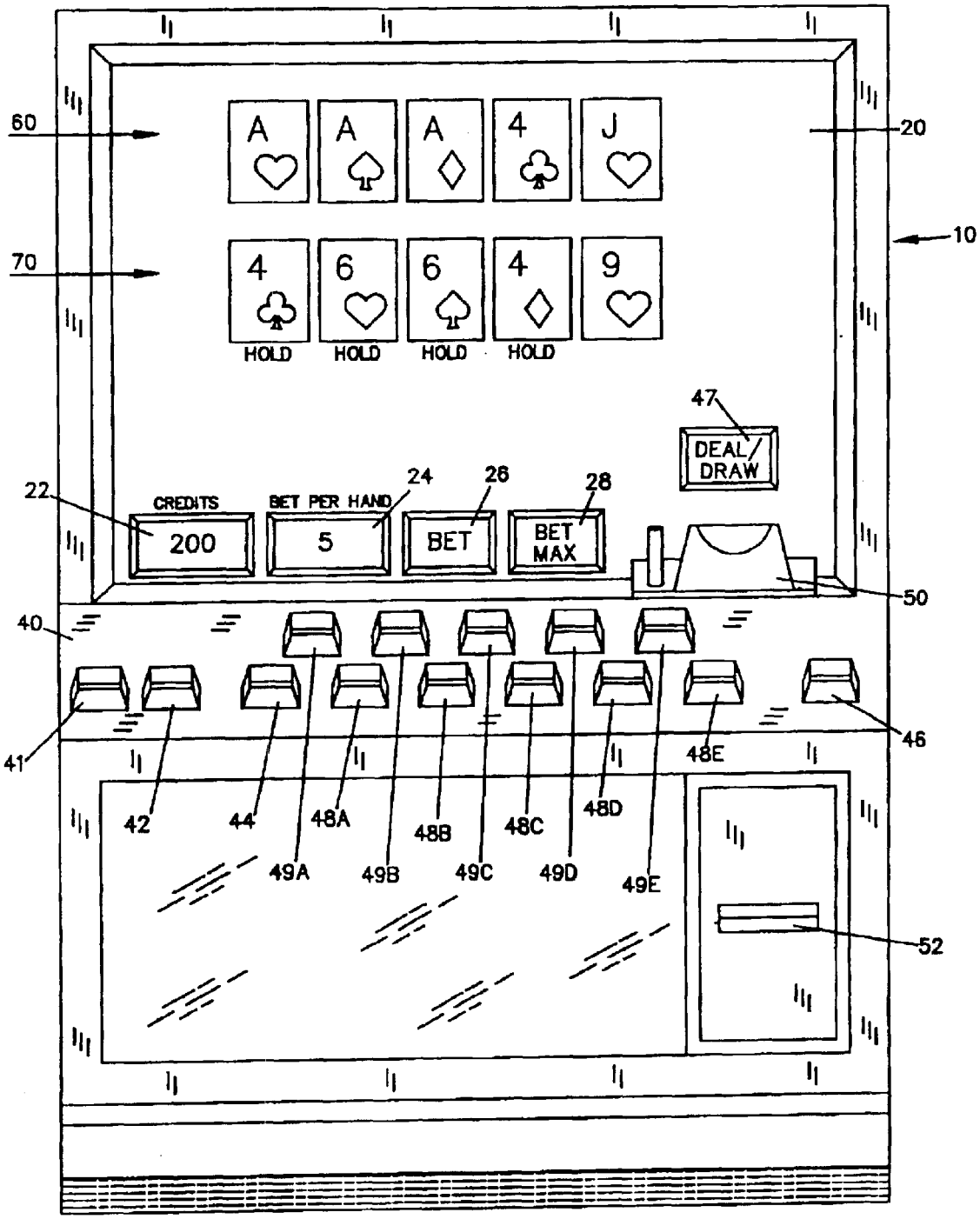
FIG. 1 shows a gaming machine configured to practice the method of present invention including a representative deal of a stud poker hand and a draw poker hand that could occur during the play of Version #1.

FIG. 1 shows a gaming machine upon which the method of the present invention can be carried out. The gaming machine 10 includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display 20 shows a credit meter 22 and a display of the "bet per hand" 24 which is the number of credits wagered on each hand for a particular round of play of the game. The video screen display also has a DEAL touch screen location to allow the player to cause the initial deal of the cards to be displayed on the video screen display 20.

Other touch screen locations allow the player to make his initial wager, which can be made one credit at a time using the BET ONE location 26 or which can be made by wagering the maximum number of credits allowed by the gaming machine using the BET MAX location 28.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits or to wager one credit at a time on the play of the game as desired by the player, if the player wishes to use buttons to place his wager instead of using the touch screen locations 26 and 28 to place his wager. A DEAL button 46 is provided to allow the player to effect the initial deal step of the method of play as desired should the player prefer to use the button panel instead of the DEAL screen location 47 on the video screen display 20.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

A plurality of buttons 48 can also be provided on the button panel 40 to allow the player to select the number of hands which the player wishes to play. For example, ONE HAND button 48A allows the player to select to play one hand of stud poker. TWO HAND button 48B allows the player to select to play two hands of stud poker. THREE HAND button 48C allows the player to select to play three hands of stud poker. FOUR HAND button 48D allows the player to select to play four hands of stud poker. FIVE HAND button 48E allows the player to select to play five hands of stud poker. Any suitable distribution of the number of hands can be allocated to the buttons and fewer or more than five buttons 48 can be used.

Instead of using buttons on the button panel, the video screen display 20 can be provided with touch screen locations (not shown) that the player would touch to select the number of hands that the player wishes to play.

The method of play of the present invention always requires the player to play one hand of draw poker. The selection of which cards the player wishes to hold during the play of the draw poker hand is effected by using buttons 49A, 49B, 49C, 49D and 49E which are aligned below the card screen locations on the screen display 20. As is conventional, the player may also select which cards to hold by simply touching the card screen locations on the screen display 20 by using touch screen technology.

Any other conventional and suitable equipment can be included in the gaming machine.

Version #1

Version #1 of the present invention in a preferred embodiment uses a standard fifty-two card deck of playing cards. A player makes a wager to activate the game and the player selects to play ONE HAND of stud poker and the required single hand of draw poker during that round of the game. In the preferred embodiment of the present invention, the player would make a first wager for the stud poker hand and a second wager for the draw poker hand. These wagers could be the same amount of credits or could be different amounts of credits.

After the wager is made and after the deck of playing cards has been electronically shuffled, a first stud poker hand of five cards 60 is randomly dealt and displayed face up to the player on the screen display. FIG. 1 shows an example of such a deal in which the player is dealt in the stud poker hand 60 the following cards: the Ace of Hearts, the Ace of Spades, the Ace of Diamonds, the Four of Clubs and the Jack of Hearts.

The player has been dealt Three-of-a-Kind (three Aces) and, using a suitable pay table for this method of play, this would be a winning hand. The player is paid according to the pay table for a Three-of-a-Kind based on the amount of the player's wager.

For example, any suitable pay table may be used and a representative pay table is shown in Table 1. The payout odds are for a single credit wagered and are multiplied by the number of credits wagered should the player wager more than one credit.

TABLE 1

| Poker Hand Combination | Payout |
|---|---|
| Less than Pair of Sevens | Losing |
| Pair of Sevens thru Aces | 1 for 1 |
| Two Pair | 3 for 1 |
| Three of a Kind | 5 for 1 |
| Straight | 7 for 1 |
| Flush | 9 for 1 |
| Full House | 18 for 1 |
| Four of a Kind (Fives through Kings) | 150 for 1 |
| Four of a Kind (Twos, Threes or Fours) | 250 for 1 |
| Four Aces | 400 for 1 |
| Four Twos, Threes or Fours with a Kicker | 500 for 1 |
| Four Aces with a Kicker | 800 for 1 |
| Straight Flush | 1000 for 1 |
| Royal Flush | 5000 for 1 |

As is generally recognized by those of skill in the art, "kicker" means an Ace, Two, Three or Four, as appropriate.

For example, assuming the player has wagered five credits on the stud poker hand 60, the player would win fifteen credits for a Three-of-a-Kind.

Other pay tables may be used and any suitable arrangement of winning poker hand combinations may also be used. For example, all of the Four-of-a-Kinds may have the same payout odds and the payouts on the other winning combinations could be changed.

The player is also dealt a five card draw poker hand 70. As shown in FIG. 1, the player is dealt in the draw poker hand 70 the following cards: Four of Clubs, Six of Hearts, Six of Spades, Four of Diamonds and Nine of Hearts. Also, as shown in FIG. 1, the player has elected to hold the Four of Clubs, Six of Hearts, Six of Spades and Four of Diamonds.

Figure 2:
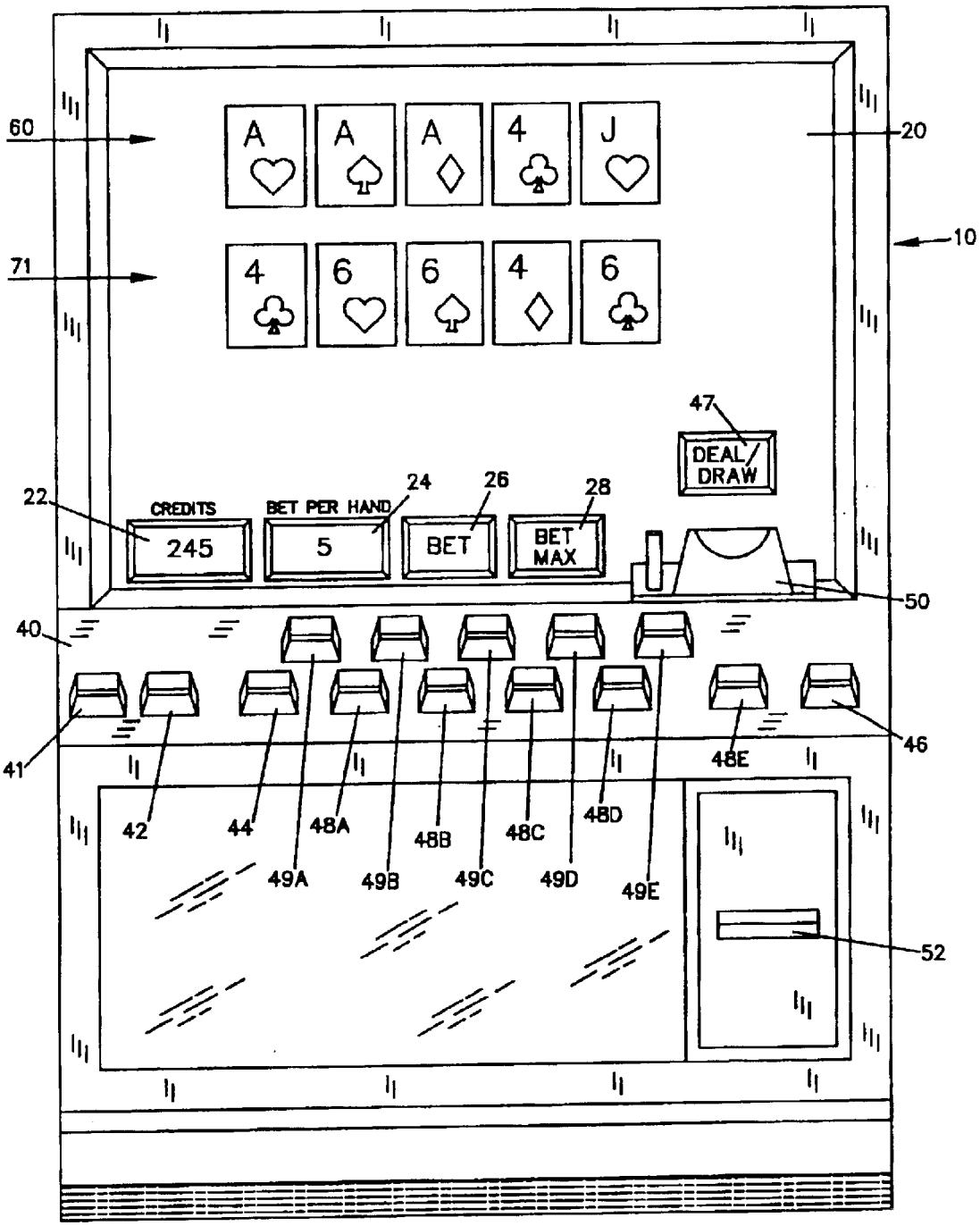
FIG. 2 shows the gaming machine with the screen display for a representative outcome of the play of the draw poker hand that could occur during the play of Version #1.

The player then presses the Draw button 47 and the Nine of Hearts is discarded and replaced with a different card from the remaining forty-seven cards in the deck. FIG. 2 shows that the player has received the Six of Clubs and the draw poker hand 71 results in a Full House.

Any suitable pay table may be used and would be associated with the poker format being used by the player. For example, the classic poker hand format is Jacks or Better Draw Poker. A suitable pay table for Jacks or Better Draw Poker is shown in Table 2:

TABLE 2

| JACKS OR BETTER DRAW POKER | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |

TABLE 2-continued

| JACKS OR BETTER DRAW POKER | NUMBER OF COINS WAGERED | | | | |
|---|---|---|---|---|---|
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Assuming the player had wagered five credits on the draw poker hand 70, the player would win forty credits for achieving a Full House after the draw step as shown in draw poker hand 71 in FIG. 2.

The cards for the stud poker hand 60 and the draw poker hand 70 are dealt from separate decks so the same cards could appear in each hand.

If the method of any of the versions of the present invention is used with one of the Joker poker formats, then the standard deck of playing cards would include one or more Jokers as would apparent to one skilled in the art and an appropriate pay table suitable for one of the Joker poker formats would be used.

Typically, pay tables are determined based on the mathematical probability of certain poker combinations occurring during the play of the game. Any suitable pay table can be used based on the percentage game return which the gaming establishment wishes to offer to the player.

Version #2.

Version #2 of the present invention uses a single draw poker hand but multiple stud poker hands.

In this Version #2, a player makes an initial wager to activate the game and the player selects the number of stud poker hands that the player wishes to play during that round of the game. The player also determines the amount of the wager that is to be allocated to each stud poker hand of cards that the player will play. The player also makes a wager to play a single hand of draw poker.

For example, the player may make a wager of thirty credits and selects to play five stud poker hands and one draw poker hand. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first hand of five cards is randomly dealt and displayed face up to the player on the screen display 20. Using another deck of standard playing cards that have been shuffled, a second hand of five cards is randomly dealt and displayed face up to the player on the screen display 20. This method of dealing continues until all five stud poker hands of five cards and the single draw poker hand of five cards are displayed to the player.

Again, any suitable poker hand combinations can be designated was winning and losing hand combinations. The amount won by the player is determined according to a pay table based on the poker hand combination achieved by the player and the amount wagered by the player. For example in this version #2, the stud poker payouts in Table 1 and the draw poker payouts in Table 2 can be used.

Figure 3:
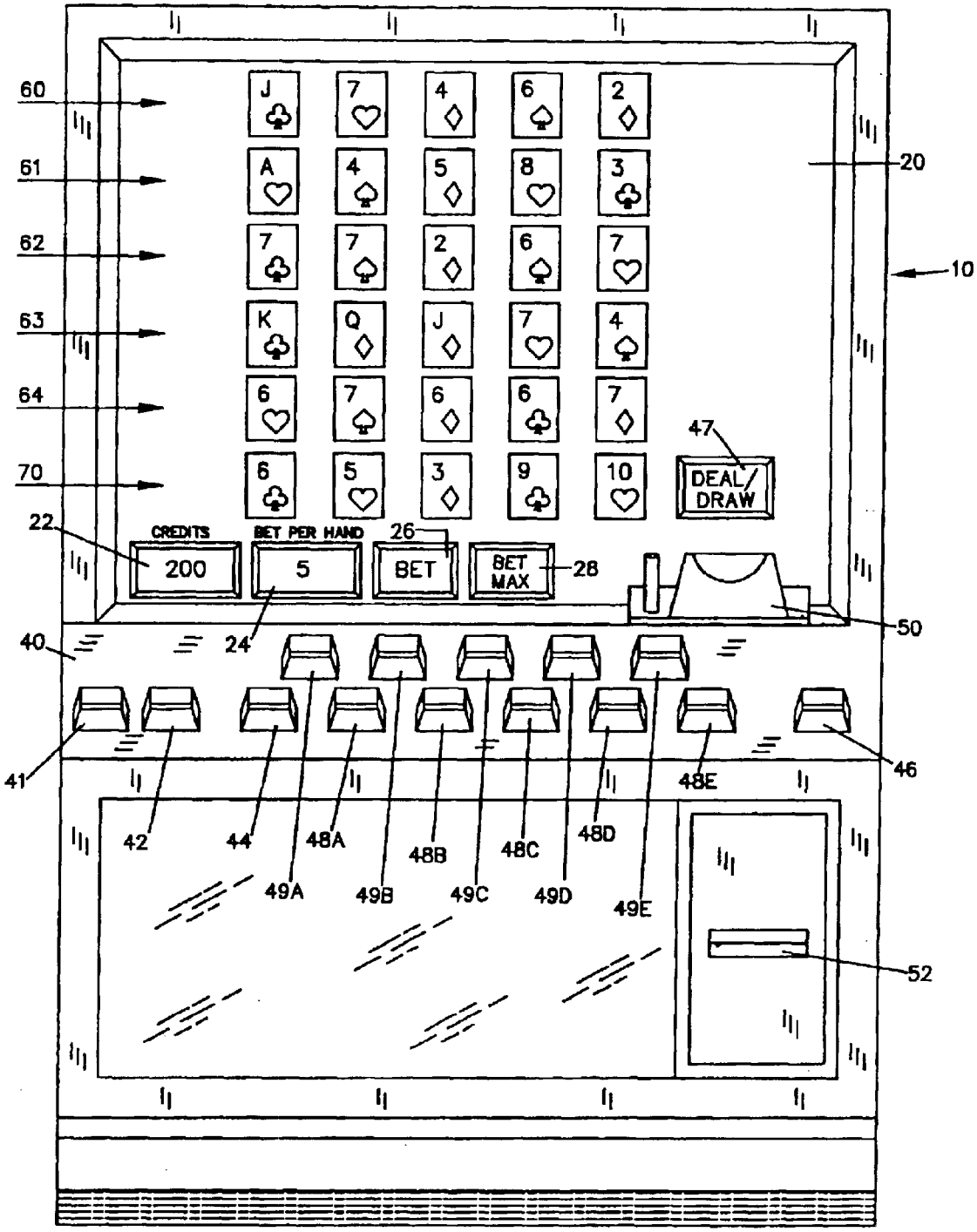
FIG. 3 shows a gaming machine configured to practice the method of present invention including a representative deal of multiple stud poker hands and a draw poker hand that could occur during the play of Version #2.

FIG. 3 shows on the video screen display 20 the first five card stud poker hand 60, the second five card stud poker 11 hand 61, the third five card stud poker hand 62, the fourth five card stud poker hand 63, the fifth five card stud poker hand 64 and the single five card draw poker hand 70.

FIG. 3 shows as a representative example of the five stud poker hands that could be dealt to a player. The first five card stud hand 60 has the Jack of Clubs, Seven of Hearts, Four of Diamonds, Six of Spades and Two of Diamonds. This would be a losing hand. The second five card stud hand 61 has an Ace of Hearts, Four of Spades, Five of Diamonds, Eight of Hearts and Three of Clubs. This would be a losing hand.

The third five card stud hand 62 has a Seven of Clubs, Seven of Spades, Two of Diamonds, Six of Spades and Seven of Hearts. This is a Three-of-a-Kind and would be a winning hand. The fourth five card stud hand 63 has a King of Clubs, Queen of Diamonds, Jack of Diamonds, Seven of Hearts and Four of Spades. This would be a losing hand.

The fifth five card stud hand 64 has a Six of Hearts, Seven of Spades, Six of Diamonds, Six of Clubs and Seven of Diamonds. This is a Full House and would be a winning hand.

The single five card draw poker hand 70 has a Six of Clubs, Five of Hearts, Three of Diamonds, Nine of Clubs and Ten of Hearts.

The player has achieved two winning stud poker hands—hand 62 and hand 64. Using a representative pay table as shown in Table 1, the player would win five credits for each credit wagered for the Three-of-a-Kind of hand 62 and eighteen credits for each credit wagered for the Full House of hand 64.

The player plays out the draw poker hand 70 which has a Ten High and is a very poor starting hand. As shown in FIG. 3, the player has elected to hold none of the cards. The player then presses the Draw button 47 and all five cards are discarded and replaced with different cards.

Figure 4:
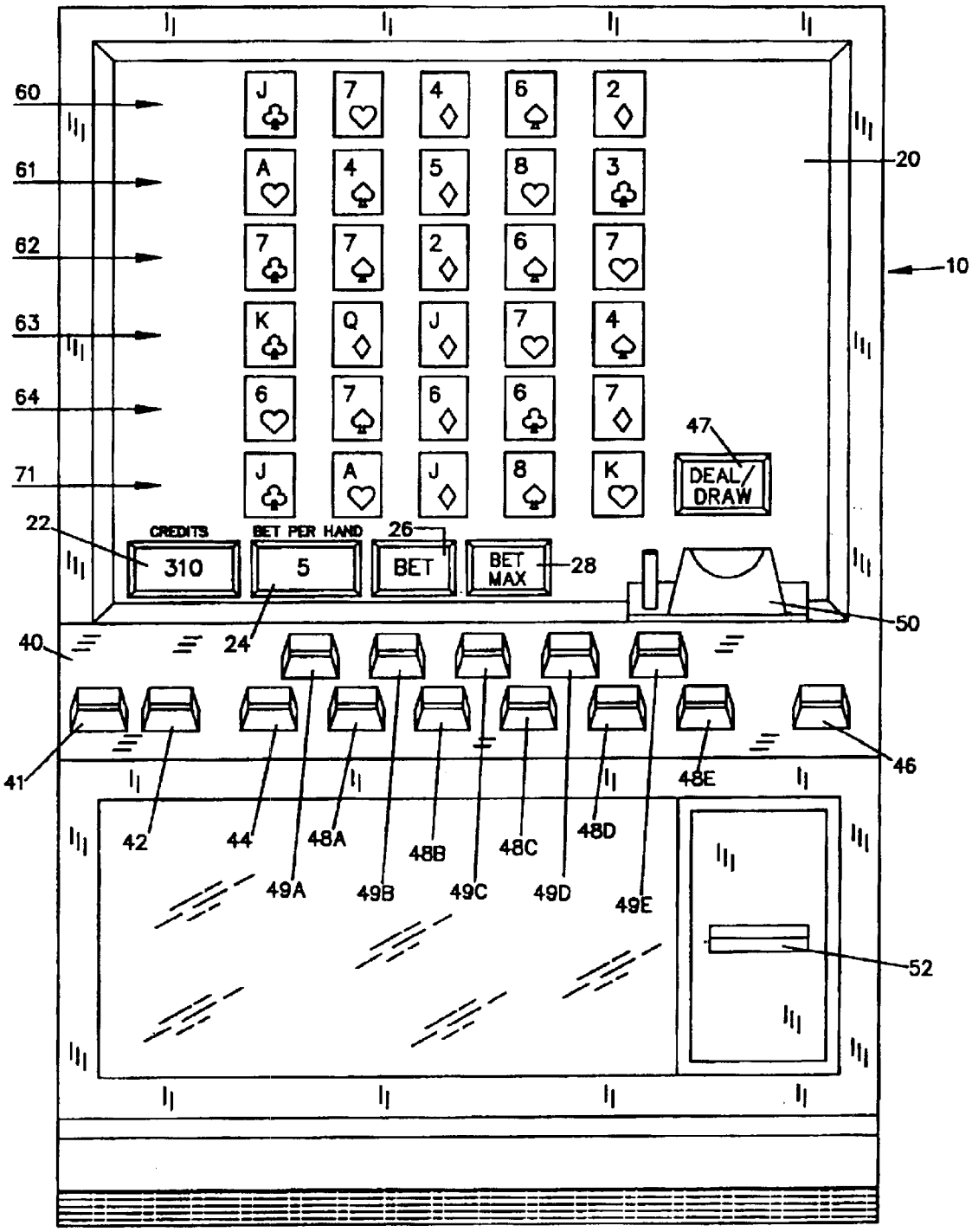
FIG. 4 shows the gaming machine with the screen display for a representative outcome of the play of the draw poker hand that could occur during the play of Version #2.

FIG. 4 shows that the player has received the Jack of Clubs, Ace of Hearts, Jack of Diamonds, Eight of Spades and King of Hearts. The draw poker hand 71 results in a Pair of Jacks. Using the payouts shown in Table 2, the player would receive an award of five credits for a Pair of Jacks or Better with five credits wagered.

Another variation can use stud hands having more than five cards—such as six card, seven card or more card stud hands. Winning hand combinations can be based on the best five card poker hand achieved out of the six, seven or more card hands. Alternatively, the winning hand combinations can be the best six, seven or more card stud poker hand achieved. When six or more card poker hands are used, then additional non-traditional poker hand rankings can be used as winning card combinations such as two Three-of-a-Kinds, or a Four-of-a-Kind and a Pair, Six (or more) Card Straight Flushes and Six (or more) Card Royal Flushes. The pay tables would be modified to account for the mathematical probabilities of achieving these different poker hand rankings.

Another variation would include designating certain cards as wild cards or adding one or more Jokers to the standard deck and using the Jokers as wild cards. When wild cards are used, the pay tables would need to be recalculated to reflect the change in the probability of the various winning hand combinations as well as any other desired card combinations (such as Five-of-a-Kinds or Wild Royal Flushes) that could be used as winning combinations.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) a player makes a first wager to play a draw poker game before any hands are displayed;

b) the player makes a second wager to play a stud poker game before any hands are displayed, the second wager being allocated over one or more stud poker hands as determined by the player;

c) displaying the one or more stud poker hands to the player;

d) determining a poker hand ranking of each stud poker hand and awarding the player an amount for each winning stud poker hand based on the poker hand ranking and the amount of the second wager according to a stud poker pay table;

e) displaying an initial draw poker hand to the player;

f) the player playing out the draw poker hand in accordance with a conventional manner of play of draw poker; and g) determining a poker hand ranking of a final draw poker hand and awarding the player an amount for a winning draw poker hand based on the poker hand ranking and the amount of the first wager according to a draw poker pay table.

2. The method of claim 1 in which each stud poker hand is displayed from a separate deck of playing cards and the draw poker hand is also displayed from another separate deck of playing cards.

3. The method of claim 1 in which each stud poker hand has five cards and the draw poker hand has five cards.

4. The method of claim 1 in which each stud poker hand has more than five cards and the draw poker hand has five cards.

5. A method of playing a card game comprising:

a) a player makes a first wager to play a draw poker game before any hands are displayed;

b) the player makes a second wager to play a stud poker game before any hands are displayed;

c) displaying the stud poker hand to the player;

d) determining a poker hand ranking of the stud poker hand and awarding the player an amount for a winning stud poker hand based on the poker hand ranking and the amount of the second wager according to a stud poker pay table;

e) displaying an initial draw poker hand to the player;

f) the player playing out the draw poker hand in accordance with a conventional manner of play of draw poker; and g) determining a poker hand ranking of a final draw poker hand and awarding the player an amount for a winning draw poker hand based on the poker hand ranking and the amount of the first wager according to a draw poker pay table.

6. The method of claim 5 in which the stud poker hand is displayed from a first deck of playing cards and the draw poker hand is displayed from a second deck of playing cards.

7. The method of claim 5 in which the stud poker hand has five cards and the draw poker hand has five cards.

8. The method of claim 5 in which the stud poker hand has more than five cards and the draw poker hand has five cards.

* * * * *